United States Patent [19]

Borst et al.

[11] Patent Number: 4,664,434

[45] Date of Patent: May 12, 1987

[54] GROUPING HEAD HOIST

[75] Inventors: Paul H. Borst; Bruce S. Johnson, both of Dallastown, Pa.

[73] Assignee: Harsco Corporation, Wormleysburg, Pa.

[21] Appl. No.: 792,586

[22] Filed: Oct. 29, 1985

[51] Int. Cl.[4] ..... B66C 1/16

[52] U.S. Cl. ..... 294/87.1; 414/404; 414/416; 53/247

[58] Field of Search ..... 294/87.1, 81.56, 81.54, 294/82.17, 82.24; 414/404, 416, 626, 786; 53/247, 539

[56] References Cited

U.S. PATENT DOCUMENTS

| | | | |
|---|---|---|---|
| 1,519,045 | 12/1924 | Panko . | |
| 2,372,478 | 3/1945 | Farr et al. . | |
| 2,784,997 | 3/1957 | Baumann . | |
| 3,606,952 | 3/1969 | Mankey . | |
| 3,652,117 | 3/1972 | Schroder . | |
| 3,780,492 | 12/1973 | Corderoy . | |
| 4,381,164 | 4/1983 | Koster et al. | 53/247 |
| 4,498,573 | 2/1985 | Anderson et al. | 294/87.1 |

FOREIGN PATENT DOCUMENTS

| | | | |
|---|---|---|---|
| 918279 | 2/1947 | France | 294/87.1 |

*Primary Examiner*—James B. Marbert

*Attorney, Agent, or Firm*—Kerkam, Stowell, Kondracki & Clarke

[57] ABSTRACT

A grouping head hoist uses a plurality of conical couplers mounted upon cables to rearrange and lift a plurality of projectiles. The couplers are locked to the eyelet at the nose of the projectiles and the cables are raised relative to a lower guide plate such that the couplers will seat within corresponding conical holes within the guide plate. The positioning of the holes in the guide plate determines the structure of the array into which the projectiles are rearranged. An upper support plate disposed above the guide plate raises and lowers the cables by operation of hydraulic cylinders connecting the upper support plate and lower guide plate. Alternately, the cables may be reeled upon reels or drums mounted within a case. An automatic release plate is used to simultaneously release numerous of the projectiles. A turn counting mechanism limits rotation of the reels upon which the cables are wound. A scissors mechanism or linkage assembly is used to stabilize the hoist.

42 Claims, 24 Drawing Figures

FIG. 3.
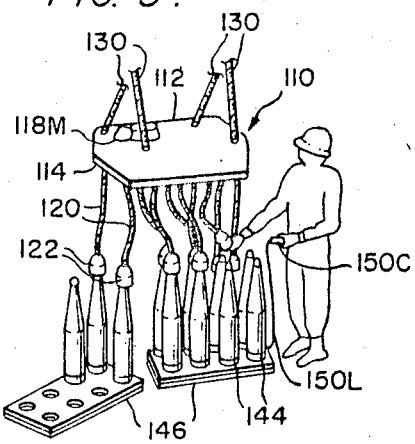
FIG. 4.
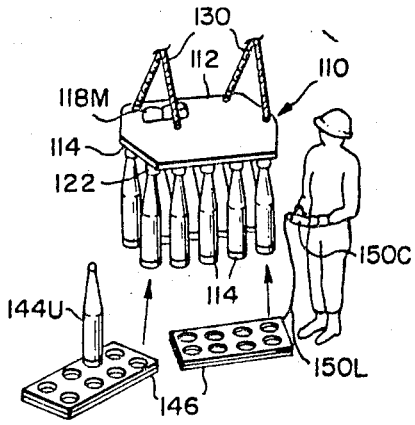
FIG. 5.
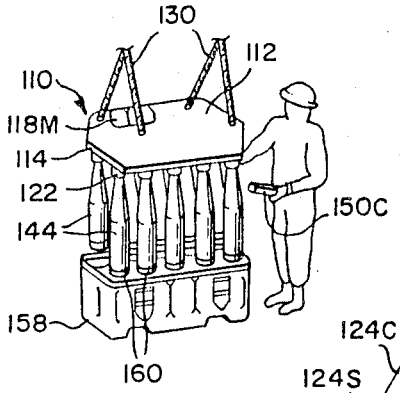
FIG. 6.
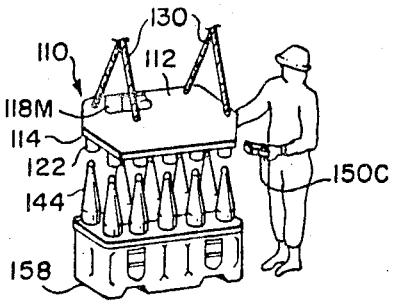
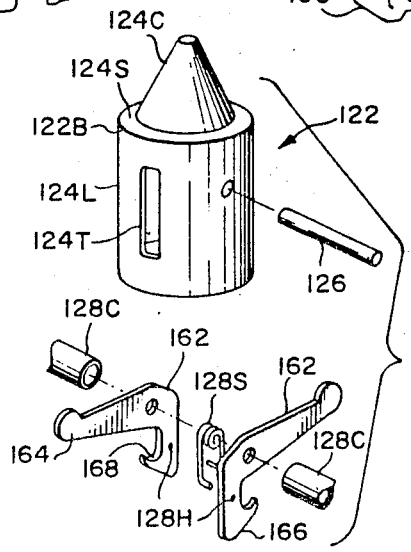
FIG. 8.

GROUPING HEAD HOIST

BACKGROUND OF THE INVENTION

The present invention relates to a hoist for rearranging a plurality of projectiles. More specifically, the present invention relates to a hoist for transferring a plurality of projectiles from one pallet to a different pallet, storage rack, or magazine.

The use of a hoist for moving heavy objects is well known in the prior art. However, such hoists are often difficult to load and unload. Complex mechanisms are sometimes required for securing the object or objects to the hoist. Finally, extra steps and/or complex mechanisms may be required to prevent banging if a plurality of articles are carried by the hoist.

The limitations of prior art hoists, such as conventional platform hoists, is especially evident when attempting to move a plurality of elongated articles from one pallet to another pallet or from one storage rack to another storage rack. Usually such articles must be moved one at a time from the first pallet to the top of a platform on the hoist. The hoist may then be moved adjacent the second pallet. The elongated articles, such as projectiles may then be moved one at a time from the platform of the hoist to positions on or within the second pallet or rack. One may readily appreciate the time consuming nature of these series of steps.

The time consuming nature of transferring projectiles from one pallet or rack to another pallet or rack by most prior art hoists is especially disadvantageous because of the absolute need to keep troops supplied with projectiles during war. Even if the transfer of projectiles from a first pallet or rack to the second pallet or rack is not made under battlefield conditions, speed of transfer is extremely important in light of the possibly devastating consequences if the troops at the front lines run short of projectiles. When the transfer of projectiles must be made under battlefield conditions, speed is even more important. Additionally, battlefield conditions require that the hoist be durable and easily movable from one position to another.

U.S Pat. No. 4,381,164 issued on Apr. 26, 1983 to Richard A. Koster and James S. Hoffman and entitled "Ammunition Transfer Sling and Method of Using", and assigned to the assignee of the present invention, provides a partial solution to many of the problems outlined above. In particular, this patent discloses a hoist having a lower guide plate slidably mounted to an upper support plate. The lower guide plate includes a plurality of holes which are used to rearrange or group a plurality of projectiles. A plurality of hooks are linked by a chain link or short cable to the lower surface of the upper support plate. The guide plate is positioned such that a number of projectiles extend through the holes and then are attached to the hooks with the upper support plate relatively close to the lower guide plate. The upper support plate is lifted relative to the lower guide plate followed by lifting both the upper support plate and lower guide plate together such that the projectiles will be arranged having a center to center distance corresponding to the center to center distance in the array of holes in the guide plate.

Although the grouping head hoist in U.S. Pat. No. 4,381,164 is quite useful, it has a number of limitations in operation. For example, the projectiles must be arranged in a relatively close group in order to allow use of this grouping head hoist. If projectiles have been knocked down or are otherwise in disarray, they must be lined up relatively evenly in order to allow the grouping head hoist to be properly used to more precisely group or arrange the projectiles. Additionally, the grouping head hoist of that patent requires a device to lift the grouping head hoist itself. In other words, the hoist must rely upon external means to lift it sufficiently in order to rearrange the projectiles.

Although the securing and unsecuring of the hooks to the projectiles in the Koster et al patent is relatively straightforward, it may be time consuming and/or awkward to secure or unsecure these hooks depending upon the configuration of the projectiles which are to be secured or unsecured to the hooks. Also, unbalanced loads (i.e., projectiles secured at one end only) may tend to tilt the hoist of Koster et al and make it difficult to properly position.

As used herein, the word "projectile" shall include any elongate type of military ammunition such as bombs, torpedoes, shells, self-propelled projectiles (i.e., rockets), bullets, and the like.

OBJECTS AND SUMMARY OF THE INVENTION

Accordingly, it is a primary object of the present invention to provide a new and improved grouping head hoist for rearranging and lifting a plurality of projectiles simultaneously.

A further object of the present invention is to provide a grouping head hoist which may be used for rearranging projectiles into a specified arrangement without the need for rearranging the projectiles one at a time even if the projectiles are in a state of substantial disarray.

A further object of the present invention is to provide a grouping head hoist which allows one to quickly secure and unsecure the projectiles.

Another object of the present invention is to provide a grouping head hoist which is quite stable even when holding unbalanced loads.

Yet another object of the present invention is to provide a grouping head hoist which will accommodate a plurality of projectiles with a minimal amount of banging or other deleterious contact between the projectiles.

A still further object of the present invention is to provide a grouping head hoist for transferring a plurality of projectiles from a first pallet or rack to a second pallet or rack and simultaneously changing the center to center distances between the projectiles.

The above and other objects of the present invention which will become apparent as the description proceeds are realized by a grouping head hoist for grouping and lifting a plurality of projectiles including: an upper support; a lower guide mounted to the upper support, the lower guide having a plurality of holes arranged in an array; a plurality of lines, each of the lines having an upper end supported by the upper support and a lower end disposable below the lower guide by extending through a corresponding one of the holes; and a plurality of couplers, each of the couplers attached at the lower end of a corresponding one of the lines and conformably shaped to seat within a corresponding one of the holes, each of the couplers including securing means securable to a nose of a projectile; and wherein the grouping head hoist is disposable in: I. a loading state with each of the couplers disposed below the lower guide such that each of the couplers are securable to a nose of a corresponding projectile; and II. a rearranging state with each of the couplers disposed at least partially in the corresponding one of the holes; and wherein the grouping head hoist is operable to rearrange projectiles into an array corresponding to the array of holes by lifting the projectiles to dispose the grouping head hoist in the rearranging state. The lower guide is a lower guide plate. Each of the couplers has at least a partially conical upper tip and each of the holes is at least partially conical. The grouping head hoist is operable to rearrange projectiles with the lower guide plate remaining stationary. The grouping head hoist further includes power drive means mounted to the lower guide plate and operable to bidirectionally vary the position of the lines relative to the lower guide plate. The power drive means is operable to change the grouping head hoist from its loading state to its rearranging state by raising and lowering the lines while the lower guide plate is stationary (i.e., not moved relative to the ground). The power drive means is operable to raise and lower the lines by raising and lowering the upper support relative to the lower guide plate. Alternately, the upper support is fixed relative to the lower guide. The power drive means is mounted to the grouping head hoist and operable to change the hoist from its loading state to its rearranging state by reeling up each of the lines upon a reel portion corresponding to each line. Each of the lines is wound around the corresponding reel portion when the grouping head hoist is disposed in its rearranging state. The power drive means includes a drive motor, a worm drive driven by the drive motor, at least one worm gear portion driven by the worm drive and operable to rotate a plurality of the reel portions. The hoist further comprises an automatic turn counting mechanism operable to limit rotation of the reel portions to a predetermined number of turns greater than one turn. The hoist further includes a plurality of pulleys, each pulley receiving a corresponding one of the lines, and a plurality of springs, each spring biasing a corresponding one of the pulleys. The hoist further comprises a linkage assembly having: a plurality of linkages, each linkage having two ends and being pivotably attached at least at one of its ends to an adjacent one of the linkages, a lower one of the linkages having an end pivotably mounted to the upper support; and a plurality of cross-linkages, each cross-linkage having two ends and being pivotably attached at least at one of its ends to an adjacent one of the cross-linkages, a lower one of the cross-linkages having an end slidably mounted to the upper support, each of the cross-linkages crossing and pivotably connected to a corresponding one of the linkages; and wherein the linkage assembly is operable to expand and contract by pivoting of the linkages and the cross-linkages and is operable to stabilize the upper support. Each of the linkages includes a channel and the hoist further comprises a pressurized-fluid power conduit mounted in the channel. The hoist further comprises releasing means operable to simultaneously release projectiles from each of the securing means. Each of the securing means is operable to prevent the release of a projectile if the projectiles weight is applied to the securing means. The releasing means includes a release plate mounted below the guide plate and downwardly movable to release each of the securing means. The releasing means further includes a release cylinder operable to pivot two release links, each release link operable to push the plate downwardly.

The present invention may alternately be described as a grouping head hoist for grouping and lifting a plurality of projectiles including: an upper support; a lower guide supported by the upper support, the lower guide having a plurality of holes arranged in an array; a plurality of lines, each of the lines having an upper end supported by said upper support and a lower end disposable below the lower guide by extending through a corresponding one of the holes; a plurality of securing means attached at the lower end of the corresponding one of the lines and securable to the nose of a projectile; and power drive means mounted to the lower guide and operable to bidirectionally vary the position of the lines relative to the lower guide; and wherein the grouping head hoist is disposable in: I. a loading state with each of the securing means disposed below the lower guide such that each of the securing means is securable to a nose of a corresponding projectile; and II. a rearranging state with each of the securing means disposed in a higher position than when in the loading state; and wherein the grouping head hoist is operable to rearrange projectiles into an array corresponding to the array of holes by lifting the projectiles to dispose the grouping head hoist in the rearranging state. The lower guide is a lower guide plate. The grouping head hoist further comprises a plurality of couplers and each securing means is part of a corresponding one of the couplers, each of the couplers has at least a partially conical upper tip and each of the holes is at least partially conical, and each of the couplers is disposed at least partially within a corresponding one of the holes when the grouping head hoist is in the rearranging state. The grouping head hoist is operable to rearrange projectiles with the lower guide plate remaining stationary. The power drive means is operable to change the grouping head hoist from its loading state to its rearranging state by raising and lowering the lines while the lower guide plate is stationary. The power drive means is operable to raise and lower the lines by raising and lowering the upper support relative to the lower guide plate.

BRIEF DESCRIPTION OF THE DRAWINGS

The above and other features of the present invention will be more readily understood when considered with the following detailed description taken in conjunction with the accompanying drawings wherein like characters represent like parts throughout the several views and in which:

FIG. 3 shows a perspective view of an alternate grouping head hoist in combination with numerous projectiles and a human operator.

FIG. 4 shows the same grouping head hoist as in FIG. 3 with the hoist lifting the projectiles.

FIG. 5 shows the same hoist as in FIGS. 3 and 4 as the projectiles are being lowered into a battlefield magazine.

FIG. 6 shows the grouping head hoist of FIGS. 3–5 after the projectiles having been deposited in a battlefield magazine.

FIG. 8 shows an exploded perspective view of a coupler.

DETAILED DESCRIPTION OF THE DRAWINGS

Figure 1:
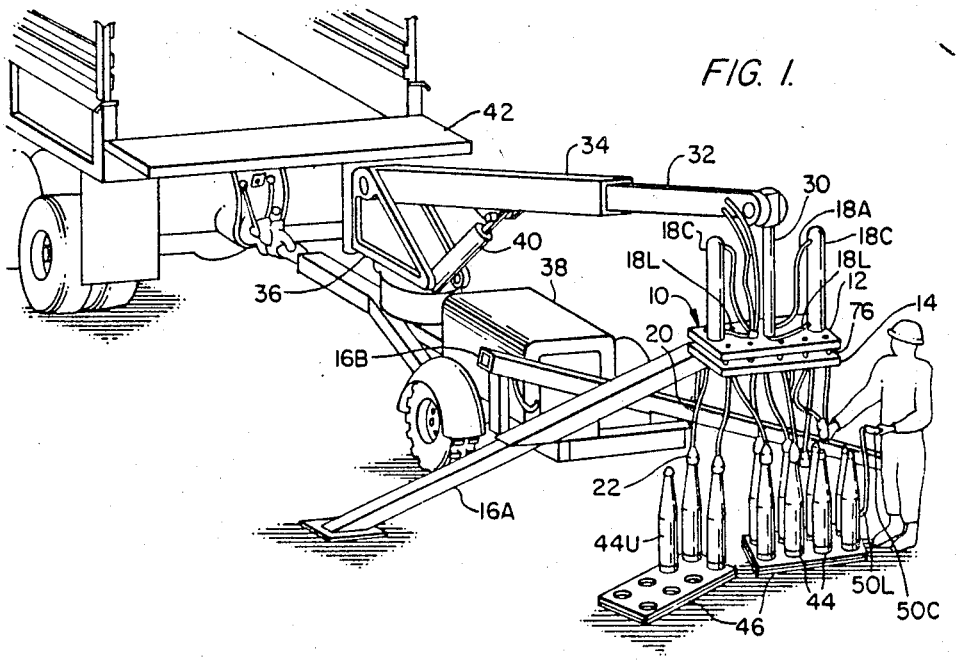
FIG. 1 shows a perspective view of a grouping head hoist, associated machinery, projectiles, and an operator.

FIG. 1 shows a perspective view of the grouping head hoist 10 and associated machinery, numerous projectiles, and a human operator. As shown, the grouping head hoist 10 is mounted upon a mounting rod 30 attached to the hydraulic boom 32 of a crane 34. The boom 32 is rotatable about a vertical axis by virtue of its mounting upon supports 36 which rotate relative to trailer 38. Additionally, the crane boom 32 is movable up and down by operation of hydraulic ram 40. As shown, the trailer 38 may be attached to the back of a truck 42.

A pair of hydraulic stabilizing legs 16A and 16B are attached to the trailer 38. The stabilizing legs prevent the trailer 38 from tipping from the movement caused by the loading of the grouping head hoist 10.

Figure 2:
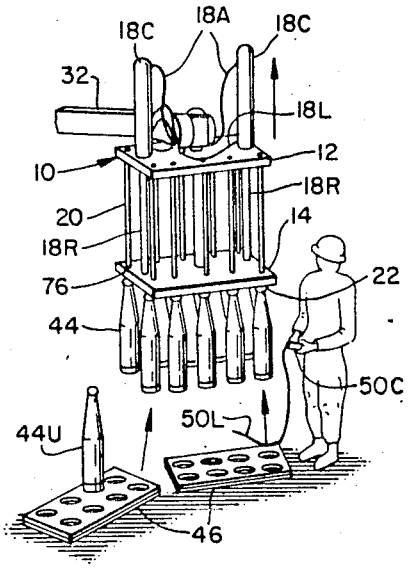
FIG. 2 shows a perspective view of the grouping head hoist of FIG. 1 lifting numerous projectiles.

Continuing to consider FIG. 1, but also considering FIG. 2, the details of the grouping head hoist 10 will be discussed. FIG. 2 shows the same grouping head hoist 10 as in FIG. 1, but it is in a rearranging mode lifting the projectiles 44. The grouping head hoist 10 includes an upper support such as plate 12 which is slidably mounted relative to lower guide plate 14. In particular, two identically constructed hydraulic cylinders 18C and associated hydraulic drive rods 18R constitute a power drive means for sliding the upper support plate 12 along the mounting rod 30 and varying the distance between upper support plate 12 and lower guide plate 14. The hydraulic rods 18R include a piston (not visible) within the hydraulic cylinders 18C and are of known construction as commonly used for varying the distance between mechanical components. The cylinders 18C are operated by hydraulic fluid in lines 18A and 18C.

Cables 20 having upper ends fixed to the upper support plate 12 extend thru holes 76 in the guide plate 14. The lower ends of cables 20 are attached to couplers 22. For ease of illustration, only one of the cables 20 and couplers 22 are numbered. Couplers 22 include a conical tip and a sleeve portion and are securable to the noses of the projectiles 44 in a manner discussed in detail below with respect to FIG. 8. Alternately, a simple quick release pin could extend through the sleeve to capture the eyelet loop of a projectile nose.

The operation of the embodiment shown in FIGS. 1 and 2 is relatively straightforward. Initially, the trailer 38 and crane 34 are positioned such that the grouping head hoist 10 is disposed above the projectiles 44. The stabilizing legs 16A and 16B are then extended to secure the trailer against tipping. Because of the hydraulic pressure supplied through lines 18L to the hydraulic cylinders 18C, the upper support plate 12 will be disposed relatively close to the lower guide plate 14 with a significant amount of cable 20 disposed below the guide plate 14. The human operator may thus connect the couplers 22 to the projectiles 44 even if they are disposed on separate pallets 46 as shown in FIG. 1. An unlifted projectile 44U may be picked up with a later load. The couplers 22 may be connected to projectiles laying on their sides or significantly spaced apart projectiles due to the length of cables 20.

Upon completing the attachments between the couplers 22 and the projectiles 44, the operator may activate control box 50C to cause high pressure pneumatic fluid to be applied to the control lines 18A. This application of high pressure fluid causes the cylinders 18C to move upwardly to the position shown in FIG. 2. Because the cylinders 18C are secured to the upper support plate, whereas the rods 18R are secured to the lower guide plate 14, the upper support plate 12 will move upwardly to the position shown in FIG. 2, whereas the lower guide plate 14 may remain stationary. The upper support plate 12 will simply slide along the support rod 30 connecting the hoist 10 to the crane boom 32. The support rod 30 is of course fixed to the lower guide plate 14.

When the hydraulic cylinders 18C and associated upper support plate 12 have reached the position shown in FIG. 2, the couplers 22 will be disposed in the corresponding holes 76 extending through the lower guide plate 14. These holes are arranged in an array in somewhat similar fashion to the holes in the above-identified Koster et al patent. However, the holes 76 in the present invention are conically shaped as discussed in more detail below with respect to the identically constructed holes 176 of FIGS. 12, 13 and 14. Additionally, the couplers 22 will be conformably shaped by inclusion of a conical tip to match the holes in the lower guide plate 14. Thus, as shown in FIGS. 1 and 2, the present grouping head hoist 10 may be used to remove projectiles from different racks or pallets and rearrange their center-to-center distances to correspond to the holes in the lower guide plate 14.

The control unit 50C simply provides an electric or other control signal by line 50L to a pneumatic valving arrangement within the trailer 38. The trailer 38 may include a hydraulic motor to supply hydraulic fluid to the lines 18A and 18L. Note that upon reaching the position of FIG. 2, any of numerous well known pressure regulating devices may be used to maintain the pressure without overloading the hydraulic motor which alternately supplies pressure to the lines 18A and 18L.

From the position shown in FIG. 2, the lifted projectiles 44 may be deposited into a battlefield magazine, rack, or similar device which is slid underneath the grouping head hoist 10. Alternately, the crane boom 32 could be moved such that the grouping head hoist 10 is over such a storage rack or battlefield magazine. Once the battlefield magazine is disposed below the projectiles 44, they may be lowered into individual storage compartments in the battlefield magazine by simply lowering the crane boom 32. Alternately, the crane boom 32 may be held stationary and the projectiles 44 may be lowered by simply lowering the upper support plate 12 relative to the stationary lower guide plate 14. The operator uses control box 50C to cause the high pressure fluid to flow to the pneumatic lines 18L to lower the upper support 12 relative to the lower guide plate 14. The couplers 22 and associated projectiles 44 may thus be lowered completely within the storage compartments having a center-to-center distance equal to the center-to-center distance of the holes 76. This center-to-center distance may be significantly different than the center-to-center distance of the projectiles as disposed on pallets 46. The couplers 22 may then be removed from the projectiles 44.

As shown in FIG. 1, with the hydraulic pressure fluid fed under high pressure through control lines 18L, the grouping head hoist 10 is in a loading state. When the hydraulic fluid is fed into the lines 18A, the upper support plate 12 will be lifted such that the grouping head hoist 10 assumes the rearranging state of FIG. 2.

Turning now to FIGS. 3–7, an alternate embodiment grouping head hoist 110 will be discussed in detail.

Figure 7:
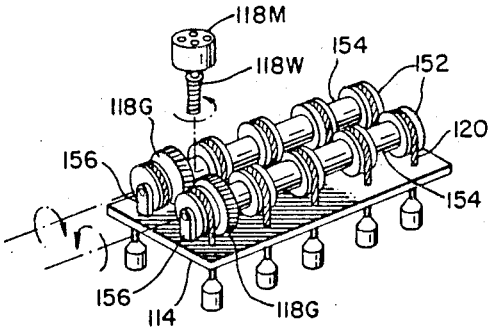
FIG. 7 shows a perspective view of a rotatable drum drive system corresponding to the embodiment of FIG. 3.

The FIG. 3 grouping head hoist 110 is generally similar in overall operation to the grouping head hoist 10 of FIG. 1. Accordingly, the numerals for the parts of the grouping head hoist 110 will have the same last two digits as the corresponding part (if any) in the FIG. 1 embodiment. FIGS. 3–6 show the grouping head hoist 110 in operation, whereas FIG. 7 shows a perspective view of the drive system within the grouping head hoist 110.

The grouping head hoist 110 is supported by support lines 130 which may be attached to a crane boom (not shown) similar to the crane boom 32 of FIG. 1. Alternately, the hoist 110 may be mounted from a bridge crane. The grouping head hoist 110 includes an upper support cover 112 and a lower guide plate 114. A hydraulic or electric motor 118M is mounted to the upper support cover 112 and is operable to both raise and lower the cables 120. The cables 120 and couplers 122, attached at their lower ends, perform in identical fashion to the corresponding cables and couplers of FIG. 1. However, the upper support 112 is disposed at a fixed distance from the guide plate 114. Instead of raising and lowering the cables 120 by moving the upper support relative to the lower guide plate as with the FIG. 1 embodiment, the FIG. 3 hoist includes a number of rotatable drums or reel portions 152 mounted to a pair of parallel shafts 154 (see especially FIG. 7) on the upper side of the lower guide plate 114. The shafts 154 may be mounted upon mounting flanges 156 at each end of the shafts 154 (only the mounting flanges at one end are visible in FIG. 7). The drive motor 118M turns a worm drive shaft 118W which in turn drives worm gears 118G which are mounted to the shafts 154. Thus, the motor 118M, which is preferably a bidirectional hydraulic motor, causes the shafts 154 to rotate and drums or reel portions 152 are fixed to rotate with the shafts 154. By winding and unwinding the cables 120 from the reel portions 152, one may vary the amount of cables 120 disposed below the grouping head hoist 110.

As shown in FIG. 3, the hoist 110 is in a loading state with the cables 120 extending relatively far below the guide plate 114. The cables 120 are supported at their upper ends by the upper support 112 by way of the guide 114 and drums 152. The couplers 122 may be attached to a number of projectiles 144.

Upon completion of attachment between the couplers 122 and the projectiles 144, the human operator may activate the hydraulic motor 118M by way of control unit or box 150C sending a signal down control line 150L. The control line 150L may extend to the hydraulic motor inside of a trailer (not shown in FIGS. 3–7) causing hydraulic fluid to flow through tubes (not shown) to rotate the hydraulic motor 118M. The motor 118M in turn causes the projectiles 144 to be reeled up into the position shown in FIG. 4. By virtue of the tightening or removal of slack, from the cables or lines 120, the projectiles 144 will be rearranged in an array corresponding to the array of holes located on the lower guide plate 114.

As shown in FIG. 5, the grouping head hoist 110 now has a battlefield magazine 158 disposed below it. The magazine 158 may have been placed underneath the hoist 110 or, alternately, the hoist 110 could be moved to be above the magazine 158. In either case, the grouping head hoist 110 may be lowered to allow projectiles 144 to seat within storage compartments or holes 160 in the magazine 158. The couplers 122 are then disconnected from the projectiles 144.

The embodiments of FIGS. 3–7 have a loading mode (FIG. 3) and a rearranging mode (FIG. 4) which are similar in function to the respective loading mode and rearranging mode shown respectively in FIGS. 1 and 3.

As shown in the sequence of FIGS. 3–6, the grouping head hoist 110 may be used to change the arrangement and/or center-to-center distances between projectiles in order to place them in a different storage rack, pallet, magazine, or similar storage apparatus unlike the hoist 10 of FIGS. 1 and 2, the hoist 110 does not require clearance above it for upward travel of an upper support.

Turning now to FIGS. 8–11, a coupler 122 will be discussed in detail. The coupler 122 includes a coupler body 122B having a conical upper tip portion 124C (shaped like a truncated cone), an annular stop surface 124S, and a cylindrical sleeve portion 124L. As best shown in the exploded view of FIG. 8, a shaft 126 extends through the sleeve portion 124L, spring 128S, and spacers 128C. Additionally, jaws 162 are pivotably mounted upon the shaft 126.

Figure 9:
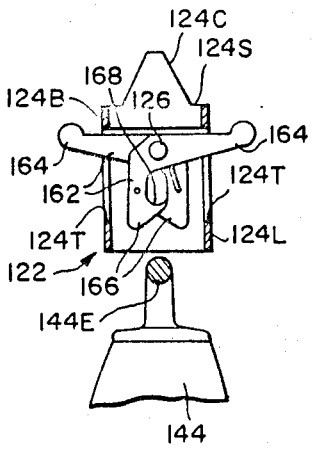
FIG. 9 shows a cross-section view of the coupler of FIG. 8 prior to its attachment to a projectile lifting eye.
Figure 10:
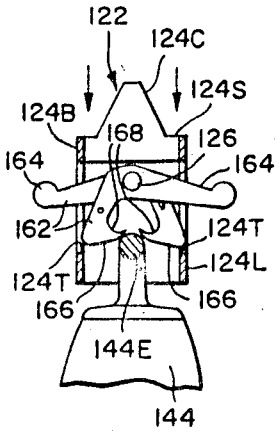
FIG. 10 shows a cross-section view with the coupler jaws spreading as they hit the lifting eye of the projectile.
Figure 11:
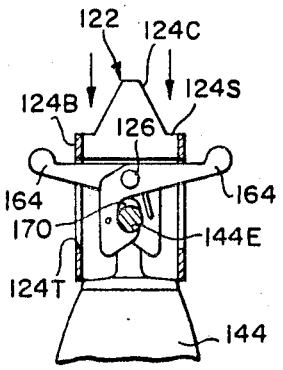
FIG. 11 shows the coupler after the coupler jaws have snapped around the projectile lifting eye.

As shown in the cross-section operational sequence FIGS. 9–11, the jaws 162 include a lever portion 164 extending through slots 124T in the cylindrical sleeve 124L. The jaws 162 further include spreading surfaces 166 which, as shown in FIG. 10, are operable to cause the pivoting of the jaws 162 by spreading of their lower ends when the coupler 122 is pressed downward onto an eyelet 144E as commonly included upon projectiles such as 144. The spreading of the jaws 162 causes the tensioning of the spring 128S secured in holes 128H disposed in the jaws.

When the coupler 122 has been pushed downwardly sufficiently, the jaws 162 will snap back to the position of FIG. 11 with locking edges 168 disposed beneath and beside the projectile eyelet 144E. The edges 168 allow the jaws 162 to be self-locking. As long as the projectile 144 is placing weight upon the jaws 162, the upward turn or curve in the locking edges 168 will prevent the jaws from being spread. However, when the projectile 144 is no longer placing weight upon the jaws 162, which function as securing means for the coupler 122, the eyelet 144E will be disposed slightly upwardly relative to the cavity 170 between the jaws 162. Thus, by the simple expedient of moving coupler 122 downwardly upon the projectile 144 (which may only be accomplished if the projectile 144 is resting upon the ground or other support surface), the locking edges 168 will be disposed sufficiently below the eyelet 144E to allow the unlocking of the securing means jaws 162.

An alternate embodiment of the coupler 22 or 122 may include a coupler body shaped identically to the coupler body 122 of FIG. 8, but without the slots 122T. This alternate simplified embodiment (not shown) may lock the projectile eyes to the coupler by simply placing a quick release pin through the sleeve portion of the coupler. Alternately, a cotter pin or any other type of device could be used, it being understood that the pin would extend through the eyelet 144E in the projectile.

Figure 12:
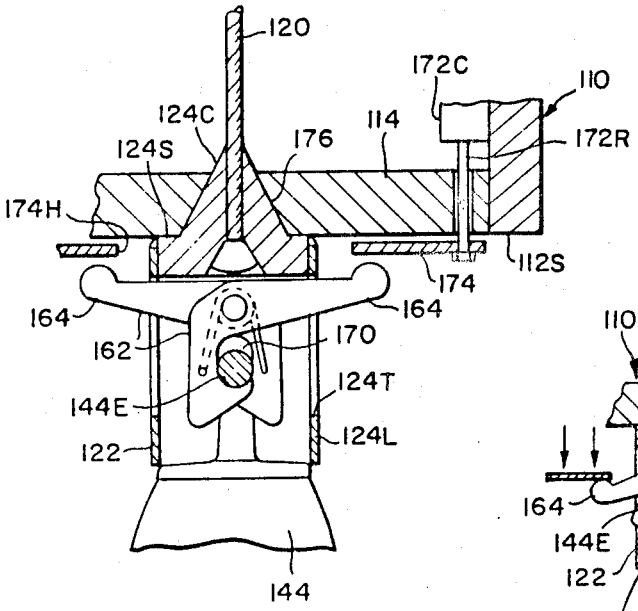
FIG. 12 shows a detailed cross-section view of a coupler and other parts of the grouping head hoist of FIG. 3.
Figure 13:
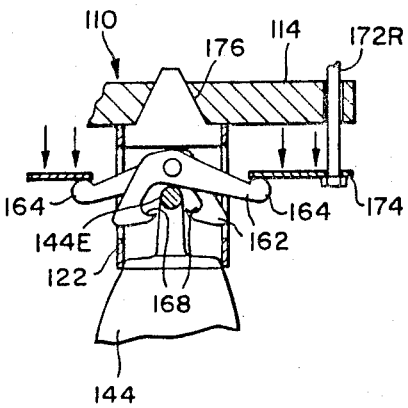
FIG. 13 shows a detailed cross-section view as in FIG. 12 after a release means has been used to release the coupler from a projectile lifting eye.
Figure 14:
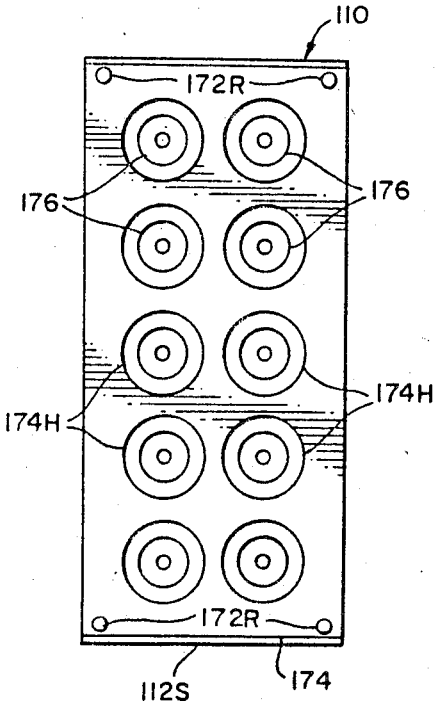
FIG. 14 shows a plane view of the bottom of the grouping head hoist of FIG. 3.

Turning now to FIGS. 12, 13 and 14, a quick release mechanism for use with the coupler 122 will be discussed in detail. Additionally, FIGS. 12 and 13 illustrate in detailed fashion how the couplers 122 fit into the lower guide plate 114 by showing cross-section views of a part of the lower guide plate 114 and associated mechanisms. FIG. 14 shows a plane view of the bottom of grouping head hoist 110.

A hydraulic cylinder 172C is mounted to the side portion 112S of cover 112. A hydraulic rod 172R extends from the cylinder 172C and is fixed to a release plate 174 which is slidably mounted relative to the lower guide plate 114. Release plate 174 is parallel to guide plate 114. By varying the supply of pressurized fluid to the hydraulic cylinder 172C, one can move the release plate 174 up and down relative to the guide plate 114. The hydraulic cylinder 172C operates in similar fashion to that discussed for cylinder 18C in the FIG. 1 embodiment of the present invention.

As shown in FIG. 12, the line 120 is taut and the conical portion 124C extends into the corresponding conical (truncated cone) 176. By virtue of the conically shaped portion 124C of the coupler 122, the coupler 122 will seat tightly within the corresponding hole 176. Thus, the projectiles 144 will be rearranged into an array corresponding to the array defined by the holes 176 (see especially FIG. 14). More generally, it will be appreciated that the coupler 122 is conformably shaped to the holes 176. Further, the stop surface 124S of the coupler 122 will ensure a precise height of the projectile 144 relative to the lower guide plate 114. As clearly shown in FIG. 12, the stop surface 124S and the relative size of hole 176 relative to coupler 122 ensures that the uppermost position of coupler 122 relative to guide plate 114 is that illustrated in FIG. 12.

A hydraulic cylinder 172C and hydraulic rod 172R are preferably situated in each of the four corners of the hoist 110 and are commonly controlled to cause all four cylinders to operate simultaneously. In the view of FIG. 12, the hoist 110 is disposed in its rearranging state with the couplers 122 (only one of which is shown in FIG. 12) disposed at least partially within the holes 176 and above the position which they have when in the loading state (refer back to FIG. 3).

In order to operate the release plate 174, the hoist 110 is lowered sufficiently that the eyelet 144E will be disposed with the weight off of the jaws 162. In other words, the eyelet 144E will be sufficiently highly disposed within the cavity 170 between jaws 162 such that the jaws 162 may be spread without the locking edges 168 binding into the eyelet 144E. When the eyelet 144E is disposed in that position, the hydraulic cylinders 172C may be activated to cause the release plate 174 to move downwardly relative to guide plate 114. This release plate 174 includes a series of holes 174H corresponding and concentric to the holes 176 (see especially FIG. 14). Upon the downward movement of the release plate 174, the release plate 174 will push downwardly upon the lever portions 164 of the jaws 162. As shown in FIG. 13, this will cause the pivoting of the jaws 162 to a position wherein the eyelet 144E is no longer secured to the securing means jaws 162. The grouping head hoist 110 may then be moved up without lifting the projectiles. Most advantageously, the human operator may simply activate a hydraulic, pneumatic, or electrical control to cause the downward movement of the release plate 174 and simultaneously release all of the couplers 122 from the corresponding projectiles 144.

Figure 15:
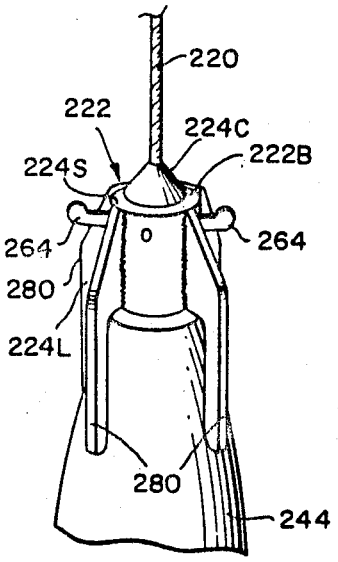
FIG. 15 shows a modified coupler attached to a projectile.

Turning now to FIG. 15, an alternate embodiment coupler 222 will be discussed. The parts of the coupler 222 are labeled with the same last two digits as the corresponding part if any in the embodiments of FIGS. 1 and 3. The coupler 222 includes a coupler body 222B having a truncated conical portion 224C separated by a stop surface 224S from a sleeve portion 224L. Because the internal workings of the coupler 222 are identical to that of coupler 122, emphasis will be placed upon the differences between couplers 222 and 122. In particular, the coupler 222 includes a number of legs 280 which extend downwardly from the sleeve portion 224L. Preferably, there are four such legs 180 which extend down around the ogive of the projectile and allow a gap of 1/16 inch to ⅛ inch between the tips of the legs and the ogive of the projectile 244. The legs 280 effectively limit the swinging of the projectile 244 when the grouping head is being moved sideways. In other words, this will minimize the bumping of one projectile against another.

Figure 16:
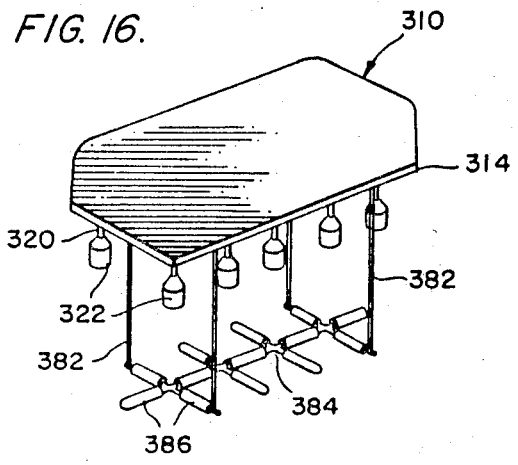
FIG. 16 shows a simplified perspective view of the FIG. 3 hoist with an optional bumper frame.

Turning to FIG. 16, an alternate optional construction for limiting the bumping of one projectile against another will be discussed. FIG. 16 uses numbers in the 300 series with the same last two digits as the corresponding parts of the previous embodiments. Again, concentrating on the differences between the grouping head hoist 310 and the previous embodiments, the grouping head hoist 310 includes couplers 322 and cables 320 identical to the corresponding components of the FIG. 3 embodiment. Further, the hoist 310 includes four small diameter steel cables or similar lines 382 which extend below the guide plate 314 to support an open frame of welded rod 384. Rubber plastic sleeves 386 are used to cover the steel frame 384. The cables 382 may be mounted upon reel portions or drum assemblies similar to that shown in FIG. 7 such that the cables 382 are reeled and unreeled along with the coupler cables or lines 320, effectively raising and lowering the frame 384 in proportion to the couplers 322. The bumper frame 384 will be disposed in between adjacent projectiles so as to minimize damage to the projectiles rotating bands if the projectiles swing slightly.

Figure 17:
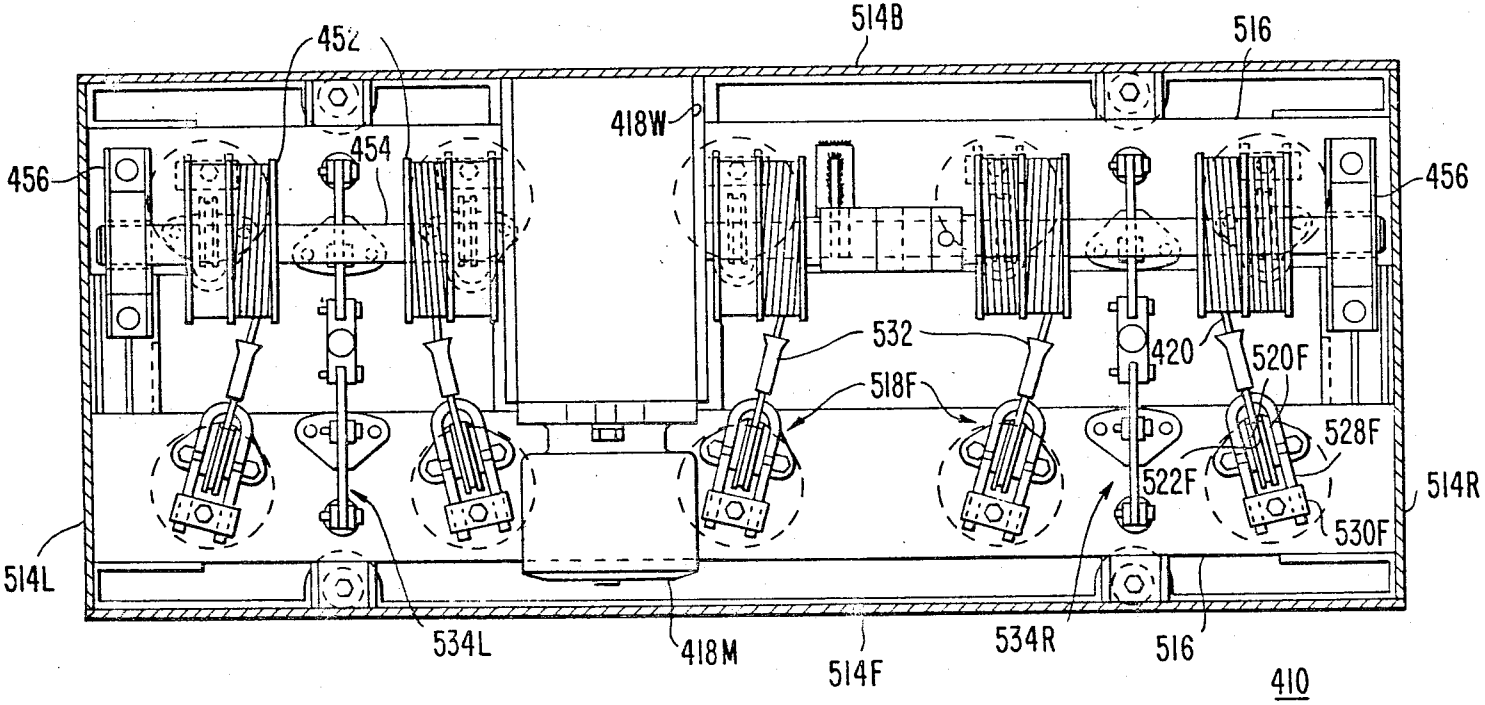
FIG. 17 shows a simplified top view with parts in cross-section of a third embodiment grouping head hoist.

With reference now to the top cross-section view of FIG. 17 (taken along lines 17—17 of FIG. 18), the front view of FIG. 18, and the cross-section view of FIG. 19 (taken along lines 19—19 of FIG. 18), a third embodiment hoist 410 will be discussed in detail. The hoist 410 includes components labeled in the "400" series having the same last two digits as a corresponding component in the hoist 110 illustrated in FIGS. 3-14. Additionally, the grouping head hoist 410 includes components in the "500" series and "600" series which do not have a generally similar corresponding part in the hoist 110. The description will emphasize differences between the hoist 410 and the hoist 110, it being understood that the hoists operate under generally similar principles.

The hoist 410 includes an upper support 412 including two lengthwise extending beams 510 (see especially FIG. 19) having a transverse beam 512 extending therebetween. Additionally, the upper support 412 includes front, back, right and left cover pieces labeled respectively 514F, 514B, 514R, and 514L. The various cover pieces are bolted, welded, or otherwise fixed to the beams 510. (For ease of illustration, the front cover piece 514F has been removed from FIG. 18 so that the inside of the hoist 410 is more readily visible.)

Fixed at the bottom of the upper support 412 is a lower guide 414 including two lengthwise extending guide beams 516 welded or otherwise fixed at their ends to the right and left side cover pieces 514R and 514L. Within the guide beams 516 are fixed guide blocks 518 having guide holes 476. The design may include a single guide block 518 in each of the guide beams 516 or, alternately, and as shown in FIG. 18, there may be five guide blocks 518 in each of the guide beams 516. The guide blocks 518 would be welded, bolted, or otherwise fixed relative to the guide beams 516.

Instead of having two shafts as with the hoist 110 (refer momentarily to shafts 154 of FIG. 7), the hoist 410 includes a single shaft 454 which extends lengthwise between shaft mounts 456 which may be bolted to the back one of the guide beams 516 (i.e., the guide beam 516 closest to back cover piece 514). The shaft 454 includes five twin reel portions 452. Each reel portion 452 is adapted to receive two cable or lines 420 which is secured to a corresponding coupler 422 (illustrated only schematically in FIG. 18). Each of the couplers 422 is identically constructed to the coupler 122 of FIG. 8.

Figure 18:
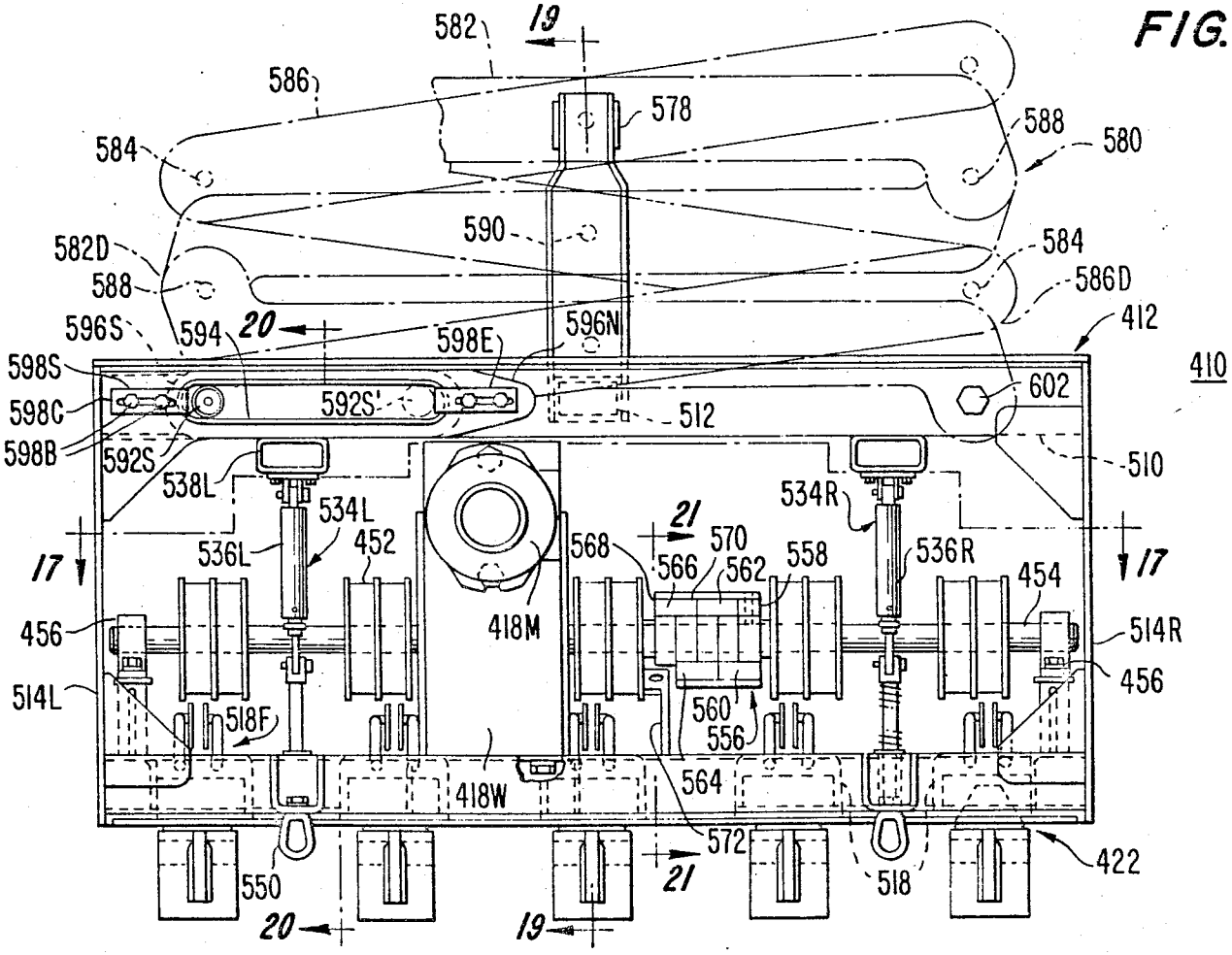
FIG. 18 shows a simplified front view of the third embodiment grouping head with a front wall broken away for clarity.

Mounted upon the front one of the guide beams 516 are five identically constructed front pulley assemblies 518F (not shown in FIG. 18). Each of the front pulley assemblies 518F includes two upwardly projecting flanges 520F, which flanges are bolted to the guide beam 515. Disposed between the flanges of a particular pulley assembly 518F is a pulley 522F having an axle 524F which is slidably captured within a slot 526F and biased by spring 528F to be disposed normally in its upper most position. As shown in FIG. 17, the spring 528F is U-shaped from above and mounted to the guide beam 516 by spring mount 530F. Corresponding to each of the front pulley assemblies 514F is a guide sleeve 532 mounted as shown in FIG. 19 and adapted to ensure that the line or cables 420 extend to the proper parts of the reel portions 452.

Mounted upon the back one of the guide beams 516 are five back pulley assemblies 518B. As best shown in FIG. 19, each of the back pulley assemblies 518B is constructed in essentially identical fashion to each of the front pulley assemblies 518F except that the spring 528B is shaped somewhat differently and the slot 526B is inclined about 15° relative to the horizontal instead of the about 45° slant in the axis of the slot 526F.

The operation of the front pulley assemblies 518F and the back pulley assemblies 518B is essentially identical except that the cables 420 proceed directly from the back pulleys 522B to the reel portions 452 and do not require use of guide tube or sleeve 532 as with the cables 420 extending around the front pulleys 522F. The spring bias used for the pulleys 522F and 522B allow the couplers 422 to each seat securely within the corresponding guide blocks 518 in spite of possible minor variations in length of the various cables 420. For example, when one of the cables 420 has pulled the corresponding coupler 422 into the corresponding guide block 518, a longer cable 420 would not yet have pulled its corresponding coupler 422 completely into the corresponding guide block 518. In order to allow the shaft 454 to continue turning until all of the couplers 422 are secured into the corresponding guide blocks 518, the spring bias of the springs 528F and/or 528B will allow continued movement of a cable 420 even after its corresponding coupler 422 is disposed in the corresponding guide block 518. With reference to FIG. 19, such continued movement will push the corresponding pulley 522F and/or 522B against the corresponding spring 528F and/or 528B.

A hydraulic motor 418M is used to power a worm drive shaft within casing 418W. The worm drive shaft in turn powers a worm gear (not shown) mounted upon the shaft 454, it being understood that the worm drive shaft and worm gear may be constructed as shown in the FIG. 7 view of the hoist 110 except that the worm drive shaft of the embodiment of FIGS. 17-19 may have a horizontal axis instead of the illustrated vertical axis for worm drive shaft 118W of FIG. 7. The motor 418M and associated worm drive gear and worm shaft serve as a power drive means for raising and lowering the cables 420, corresponding couplers 422, and any projectiles such as 444 which may be attached to the couplers.

Continuing to view FIGS. 17-19, but also considering the simplified cross-section view of FIG. 20 (taken along lines 20—20 of FIG. 18), automatic release toggle assemblies 534R and 534L will be described. As the automatic release assemblies 534R and 534L are identically constructed, the discussion will concentrate on the left assembly 534L. The assembly 534L includes a hydraulic cylinder 536L mounted to a cross beam 538L fixed to the upper beams 510. The hydraulic cylinder 536L includes a hydraulic piston (not shown) therein and is operable to vary the vertical height of a connecting plate 540L. Two release links 542L are pivotably connected to the connecting plate 540L and are pivotably connected intermediate their ends at fixed supports 544L. Release rods 546L are pivotably mounted at the outer ends of the release links 542L and extend through sleeves 548L extending vertically in the guide beams 516. A release plate 474 is bolted or otherwise attached to the lower end of the release rods 546. The release plate 474 may be constructed in essentially identical fashion to the release plate 174 shown in FIG. 14. That is, the release plate 474 would include sufficiently large holes 474H (FIG. 19 only) to allow the release plate 474 to operate in identical fashion to the release plate 174. Additionally, the release plate 474 would include holes (not shown) allowing for lifting eyes 550 to extend through the release plate 474 when shown in its upper solid line position of FIG. 20. As shown, the optional lifting eyes 550 may be mounted upon members 552 welded between the front piece 514F and the front one of the beams 516 and the back cover piece 514B and the back one of the beams 516. Mounted upon each of the release rods 546L is release spring 554L only one of which is shown in FIG. 20 for ease of illustration. The springs 554L (as well as corresponding springs mounted upon the right toggle assembly 534R) bias the release plate 574 upwardly to the solid line position of FIG. 20. Additionally, the springs 554L act through release links 542L to bias the connecting plate 540L to its lower position shown in solid line in FIG. 20.

In order to operate the release plate 474, pressurized fluid is fed to the hydraulic cylinder 536L such that the connecting plate 540L is moved upward from its solid line position in FIG. 20 to its dotted line position in FIG. 20. This in turn causes the release links 542L to push downwardly on the release plate 574L by action of the release rods 546L and against bias of the springs 554L. As illustrated on the right side of FIG. 20 only, the lifting of the connecting plate 540L causes the release links 542L to tilt in the manner shown in the dotted line position of the back side (i.e., shown on right of FIG. 20) release link 542L. The hydraulic cylinder 536R is powered from the same hydraulic source and simultaneously with the hydraulic cylinder 536L such that the right and left toggle assemblies 534R and 534L operate simultaneously to lower the release plate 474 from its solid line position of FIG. 20 to its dotted line position of FIG. 20. Provided that the projectiles 444 (FIG. 19) are supported at their bottoms such that the couplers 422 may be released, the automatic release plate 474 will simultaneously release the connections between all of the conical couplers 422 and the corresponding projectiles 444. As illustrated by the dotted line position of release plate 474 on the left or front side of FIG. 9, the release plate 474 releases the projectiles in identical fashion to the release plate 174 illustrated in FIGS. 12 and 13 and discussed in detail above. It will of course be appreciated that the couplers 422 may be identical to the couplers 22 shown in FIGS. 12 and 13.

After the release plate 474 has been used to release all of the projectiles 444, the hydraulic fluid used to power the hydraulic cylinders 536R and 36L may be reversed to bring the release plate 474 back to its upper, solid position of FIG. 20. Alternately, the hydraulic fluid source may simply stop supplying pressurized fluid to the hydraulic cylinders and allow the four release springs (such as spring 554L) to return the release plate 474 to its solid line position immediately adjacent the underside of the guide beams 516.

Figure 21:
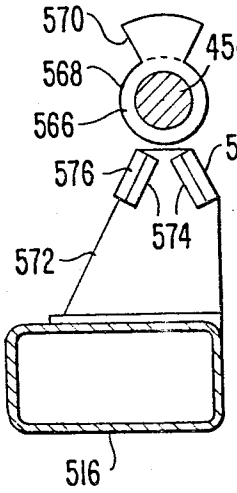
FIG. 21 shows a cross-section simplified view taken along lines 21—21 of FIG. 18 and illustrating a part of a turn counting mechanism used with the present invention.

Referring now to FIGS. 18 and 21, an automatic turn counting mechanism 556 including segments 558, 560, 562, 564, and 566 is mounted upon the shaft 454. The segment 558 is secured by a set screw to the shaft 454 for turning therewith, whereas the remaining segments are mounted upon the shaft 454 but free to rotate with respect to the shaft. As shown in the simplified cross-section view of FIG. 21 (taken along lines 21—21 of FIG. 18 and leaving out all of the segments except segment 566), the segment 566 includes an annular ring portion 568 and a radially outwardly projecting flange portion 570. As illustrated from the view of FIG. 18, the flange portion 570 also projects in an axial direction (i.e., along axis of shaft 454). The segments 560, 562, and 564 may be identically constructed to the segment 566, whereas the segment 558 may have an outwardly projecting radial flange such as 570, which flange does not project axially. Mounted adjacent the segment 566 is a stop mounting plate 572 having two stop flanges 574 projecting perpendicularly from the plane of plate 572. The flanges 574 may be metallic and integral with the plate 572 although other arrangements and materials could also be used. Attached upon the stop flanges 574 are two rubber bumper pads 576. As shown in FIG. 21, the stop mounting flange 572 is welded or otherwise attached to one of the guide beams 516.

The automatic turn counting mechanism 556 including the various segments, stop mounting plate 572, stop flanges 574, and rubber bumper pads 576 is used to limit the rotation of the shaft 554. In particular, the segment 558 is secured to rotate with the shaft 554. When the radial flange (similar to flange 570, but not axially extending) of the segment 558 contacts the axially extending radial flange of segment of 560, the segment 560 will rotate with the segment 558. In similar fashion, the segment 562 will rotate with segments 560 and 558 when the axially extending radial flange of segment of 562 is engaged by the flange of segment 560. Likewise, when the flange of segment of 562 contacts the flange of segment 564, segment 564 will rotate with the initial segment 558 and the intervening segments. Finally, when the radial flange of segment 564 contacts the radial flange 570 of segment 566, the segment 566 will rotate with the original segment 558 and the intervening segments. Upon the segment 566 rotating to an angle such that its radial flange 570 hits one of the bumper pads 576, the shaft will be unable to rotate further. The hydraulic motor 418 may include an arrangement to automatically turn off upon sensing an overload such as the shaft 454 being stopped from further rotation by one of the bumper pads 576. Thus, the automatic turn counting mechanism 556 prevents the shaft 454 from rotating too far in either direction such that the cables 420 are not reeled out too far or reeled in too far. Depending upon the angular width of the segment flanges or tangs such as 570 of segment 566, the turn counting mechanism 556 may limit rotation of the shaft 454 and the corresponding reel portions 452 (which rotate with the shaft 454) to a predetermined number of turns. In order to avoid having the reel portions 452 excessively large in diameter, it is highly preferred that the automatic turn counting mechanism 556 allow more than one complete turn. Preferably, the turn counting mechanism 556 will allow two and one half complete turns of the shaft 454 and reel portions 452. Additional or fewer number of the segments could be used depending upon the actual number of turns desired.

Figure 19:
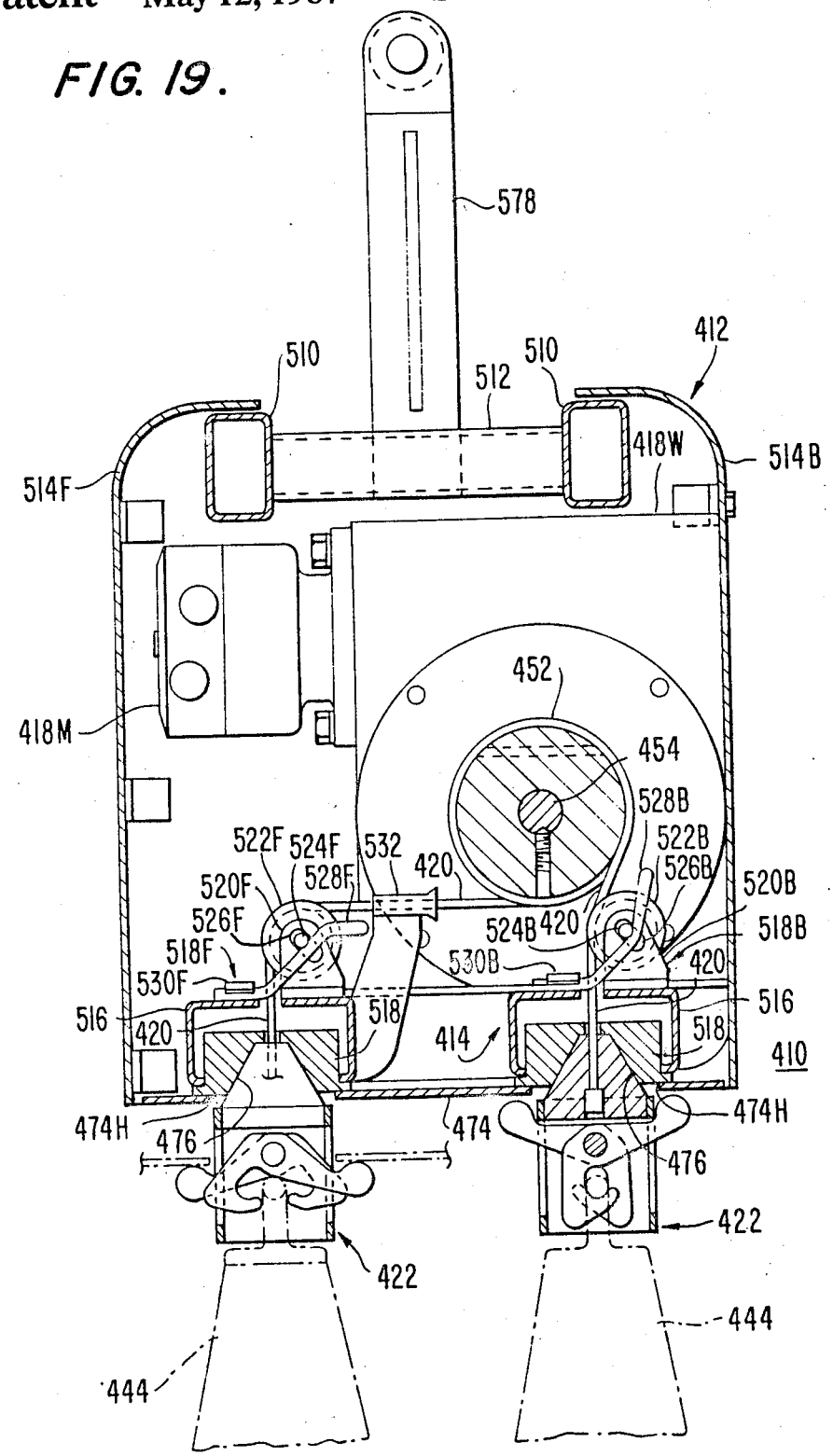
FIG. 19 shows a cross-section view taken along lines 19—19 of FIG. 18 and illustrating alternate coupler positions on left and right sides of the Figure.
Figure 20:
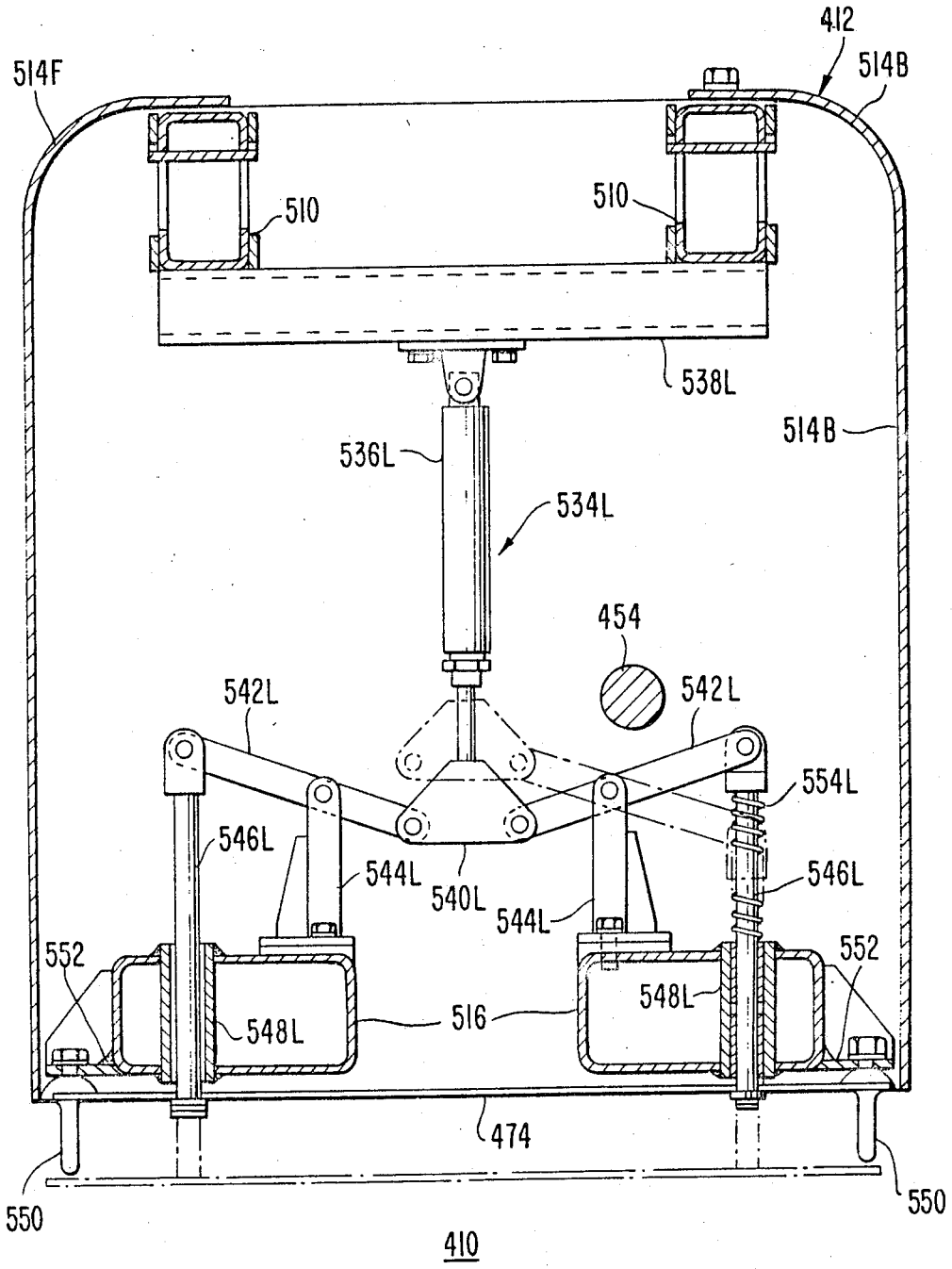
FIG. 20 shows a simplified cross-section view taken along lines 20—20 of FIG. 18 and illustrating a release link structure used with the present invention.

With reference now to FIGS. 18 and 19, the arrangement for securing the hoist 410 to a crane (such as crane 34 of FIG. 1) will be discussed. A support post 578 is fixed to the beam 512 and extends upwardly therefrom. The support post 578 may be connected to a cable (not shown) by a clevis (not shown) or otherwise, the cable bearing the load of the grouping head hoist 410 and any projectiles attached thereto.

Figure 22:
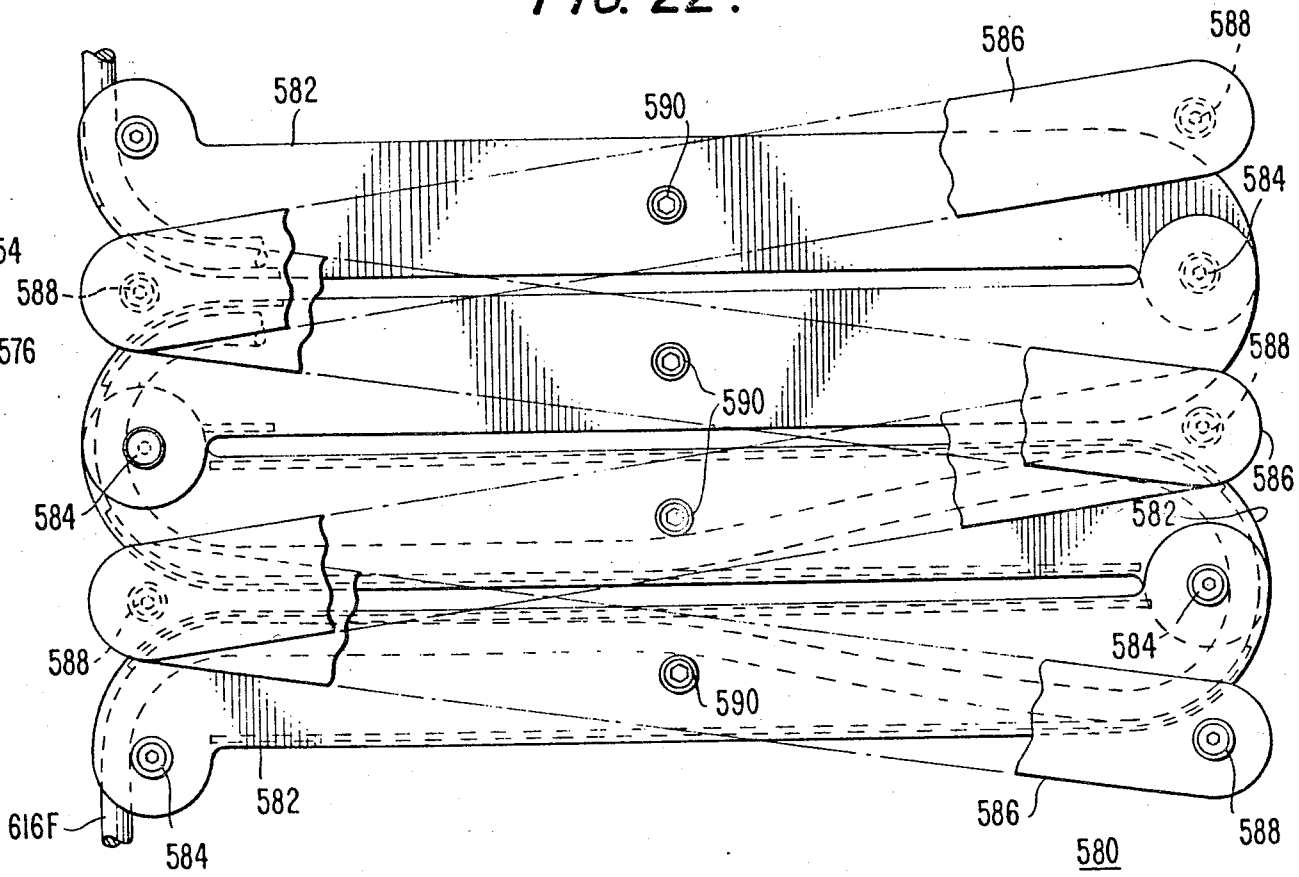
FIG. 22 shows a front view of a linkage assembly as used with the present invention.
Figure 23:
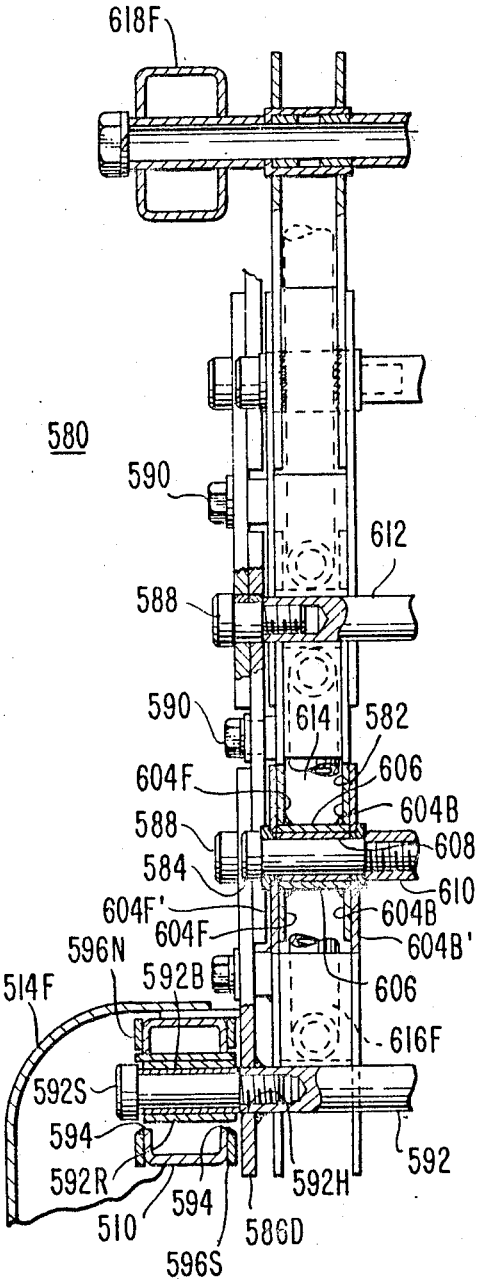
FIG. 23 shows a cross-section view of one side of the linkage assembly of FIG. 22 and illustrating the attachment of the linkage assembly to the hoist structure.
Figure 24:
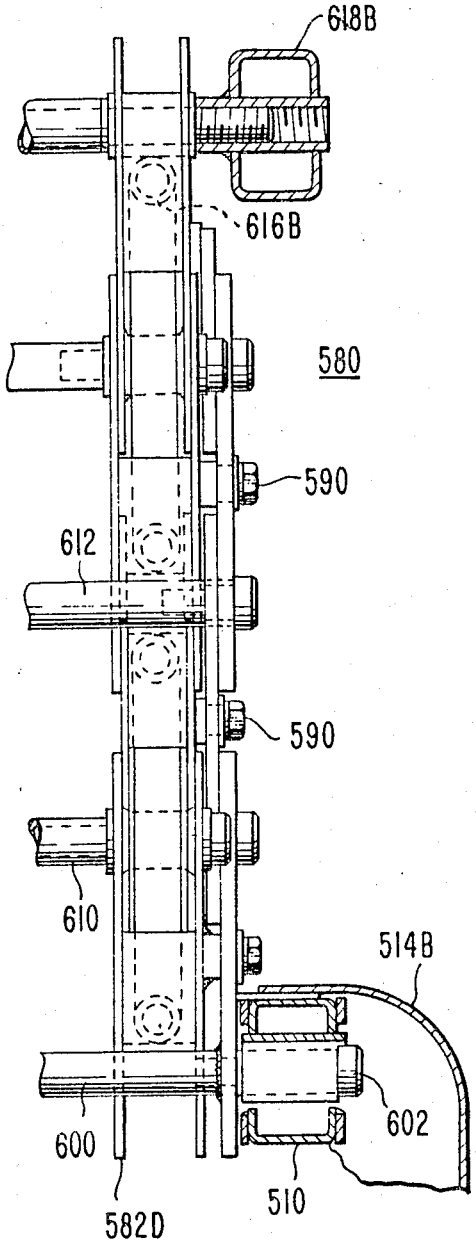
FIG. 24 shows a cross-section view similar to that of FIG. 23 except that it illustrates a pivoting connection between one side of the linkage assembly and the upper support of the hoist.

Instead of using stabilizer legs such as 16A and 16B as shown in the FIG. 1 embodiment or a plurality of different cables 130 as shown in the FIG. 3 embodiment, the grouping head hoist 410 includes a linkage assembly 580 as shown in FIGS. 18, 22, 23, and 24. The linkage assembly 580 includes identical structures on the front of support post 578 and the back of support post 578. FIG. 22 shows a front view of parts of the front portion of linkage assembly 580. FIG. 23 shows a cross-section view of parts of the front portion of linkage assembly 580, whereas FIG. 24 shows a cross-section view of parts of the back portion (i.e., behind the support post 578) of the linkage assembly 580.

As best shown in FIG. 22, the front portion of the linkage assembly 580 (the back portion is substantially identical) includes a plurality of "S-shaped" links 582 which are pivotably attached to each other at their ends at pivot points 584. Cross links 586 extend across the links 582 and are pivotably attached to each other at pivot points 588. Additionally, the cross links 586 are pivotably attached at center pivot points 590 to corresponding ones of the S-shaped links 582. For ease of illustration, FIG. 22 includes only four of the links 582 and four of the cross links 586, it being understood that more or less of the links may be used. Additionally, FIG. 22 does not include the furthest down "S-shaped" link 582D (shown in FIGS. 18, 23, and 24) and the lowest straight cross link 586D (shown in FIGS. 18, 23, and 24).

With reference now to FIGS. 18 and 23, the connection between the lowest cross link 586D and the upper support 412 of hoist 410 will be discussed in detail. Mounted at the lowest end of the flat, straight, cross link 586D is a slide axle 592 extending through a corresponding circular hole 592H in the cross link 586D. Each end of the slide axle 592 includes a corresponding screw 592S extending through a cylindrical bearing 592B, which in turn is within a cylindrical roller sleeve 592R. The screw 592S extends through an elongate slot 594 extending lengthwise in the upper support beams 510. Recalling that the slide axle 592 is only partially shown in FIG. 23 and that it extends to a similar sliding connection with the beam 510 not shown in FIG. 23, it should be appreciated that the slide axle 592 provides for movement of the front and back cross links 586D within the constrains defined by the slots 594. As shown in FIG. 18, a reinforcing plate 596N extends along the length of the slot 594 and includes a slot which coincides with slot 594. A shorter length reinforcing plate 596S also including a coinciding slot is disposed on the back (i.e., as viewed from FIG. 18) side of the frame beam 510. A contraction stop plate 598C has elongate slot 598S in which two bolts 598B extend. The bolts 598B additionally extend through the reinforcing plate 596N and into the frame or upper support beam 510. The bolts 598B allow the contraction stop plate 598C to be varied in position relative to the slot 594. That is, by loosening the bolts 598B and sliding the plate 598C to a new position before tightening the bolts, the plate 598C may be positioned to stop the bolt of 592S at a different stop position. An expansion stop plate 598E is mounted in similar fashion adjacent the other end of the slot 598 and may be used to vary the stop position of the bolt 592S when the scissors mechanism or linkage assembly 580 is in an expanded position coinciding with the bolt 592S being in the position indicated in dotted line as 592S'. Only the stop plates 598C and 598E corresponding to the front one of the frame beams 510 is shown in FIG. 18, but it will be readily understood that similar stop plates are mounted upon the back one of the frame beams 510.

With reference now to FIG. 18 and FIG. 24, the connection between the lowest S-shaped link 582D and the upper support 412 of hoist 410 will be discussed. Mounted upon the lowest link 582D is a pivot axle 600 extending between identically arranged bolts 602 (only the back one shown in FIG. 24) which secure the axle 600 to pivot relative to fixed pivot points extending through the frame beams 510.

Considering FIGS. 18, 22, 23, and 24 together, the structure of the links 582 and the cross links 586 will be discussed. As best illustrated in FIG. 23, each of the links 582 include two elongate pieces 604F and 604B which may be connected together by pieces 606. Additionally, a cylindrical sleeve 608 extends between the pieces 604F and 604B and accommodates the bolts corresponding to the pivot point 584. Attached to the bolt is a pivot axle 610 which extends from the front of the linkage assembly 582 to a symmetrically arranged construction at the back of the linkage assembly 580. As also best shown in FIG. 23, the cross link pivot points 588 correspond to a bolt attached to an axle 612 which may likewise extend back to the corresponding identically constructed back portion of linkage assembly 580. It should also be noted that the S-shaped linkages 582 are interleaved in that one of the linkages 582 will extend to within another of the linkages 582. Note for example how the members 604F' and 604P' of FIG. 23 are just outside the members 604F and 604B. In other words, the links 582 alternate between inner and outer links. In similar fashion, the cross links 586 lie in either of two parallel vertical planes (view of FIG. 23) with cross links in the same plane separated by a cross link in the other of the planes.

Between each of the twin members 604F and 604B of the links 582 is a channel 614 (labeled in FIG. 23 only) through which a pressurized fluid power conduit or hydraulic hose 616F extends. As best shown in FIG. 22, the hose 616F may extend around the various channels bending around the pivot points 584 in the "S-shaped" links 582. A similar conduit 616B may extend in the back portion of the symmetrically constructed linkage assembly 580. Although only a single power conduit or hose is shown in each of the front and back parts of linkage assembly 580, it will be readily appreciated that more than one of the hydraulic fluid lines may extend within a single channel. These hydraulic fluid lines 616F and 616B may be used to supply powered hydraulic fluid to the motor 418M and the hydraulic cylinders 536R and 536L.

The scissors mechanism or linkage assembly 580 may be connected at its top to a crane by way of crane beams 618F and 618B. Although not shown in detail, it should be appreciated that the scissors mechanism or linkage assembly 580 should be attached to the beams 618F and 618B in similar fashion to their attachments to the beams 510 on the hoist 410. In other words, the linkage mechanism 580 would include at its top an end which slides relative to the crane and another end which pivots about a fixed axis relative to the crane.

Although the crane itself is not a necessary part of the present invention, it should be noted that the present design is especially well suited for use with the "Portable Folding Bridge Crane" as disclosed in U.S. patent application Ser. No. 736,834 filed on May 22, 1985, invented by Bruce S. Johnson, and assigned to the assignee of the present application.

The operation of the linkage assembly 589 stabilizes the grouping head hoist 410 under an unbalanced load. That is, it prevents the hoist 410 from tilting or otherwise becoming unstable. Also, it protects the conduit hoses and/or any electrical cables extending to the hoist.

The cable which would be attached to the support post 578 would generally carry the load of the hoist 410 and any projectiles attached to it. As the cable (not shown) is lowered or raised, the linkage assembly 580 may contract or expand. In the position shown in FIG. 18, the assembly 580 is contracted with the links 582 and 586 being at only a slight angle with respect to the horizontal. The slide bolt 592S is in the solid line position. When the cable attaching support post 578 to the crane is lowered or lengthened, the links 582 and 586 will become more tilted relative to the horizon and will spread apart. The pivot points 584 and 588 vertically above the fixed pivot point 602 will remain vertically in line with pivot point 602, whereas the central pivot points 590 and the pivot points 584 and 588 disposed above the slide bolt 592S will generally move in a rightward direction. The conduits 516F and 516B are protected in the channel 614 as the linkage assembly 580 extends or expands. Likewise, electrical cables (not shown) may extend in the channels 614 from the crane to the hoist 410. The stop plates 598E will determine how far the linkage assembly 580 may be expanded or extended.

When the hoist 410 is raised relative to the crane upon which it depends, the linkage assembly 580 will, by pivoting of its links 582 and 586, return to its contracted position shown in FIG. 18.

The grouping of projectiles by raising them into rearranging states with the conical shaped couplers 422 in the corresponding holes 476 is accomplished in the same fashion as explained in detail above with respect to the earlier embodiment and with reference to FIGS. 3–13. The automatic release operation of the hoist 410 is essentially similar to that shown in FIGS. 12 and 13 except that the arrangement for moving the release plate 474 downwardly uses the toggle assemblies 534R and 534L.

Although various specific constructions and details have been disclosed herein, it is to be understood that these are for illustrative purposes only. Various modifications and adaptations which come within the spirit of the invention will be readily apparent to those of ordinary skill in the art and reference to the claims appended hereto should be made to determine the full scope of the invention.

What is claimed is:

1. A grouping head hoist for grouping and lifting a plurality of projectiles comprising:

(a) an upper support;

(b) a lower guide mounted to said upper support, said lower guide having a plurality of holes arranged in an array;

(c) a plurality of lines, each of said lines having an upper end supported by said upper support and a lower end disposable below said lower guide with the line extending through a corresponding one of said holes; and (d) a plurality of couplers, each of said couplers attached at the lower end of a corresponding one of said lines and conformably shaped to matingly seat within a corresponding one of said holes, each of said couplers including securing means securable to a nose of a projectile; and wherein said grouping head hoist is disposable in:

I. a loading state with each of said couplers disposed below said lower guide such that each of said couplers is securable to a nose of a corresponding projectile; and II. a rearranging state with each of said couplers disposed in an uppermost position relative to said lower plate and being seated at least partially in the corresponding one of said holes; and means operable to lift the projectiles and rearrange said projectiles into an array corresponding to said array of holes thereby assuming said rearranging state.

2. The grouping head hoist of claim 1 wherein each of said couplers has at least a partially conical upper tip and wherein each of said holes is at least partially conical.

3. The grouping head hoist of claim 1 wherein said grouping head hoist is operable to rearrange projectiles with said lower guide remaining stationary.

4. The grouping head hoist of claim 1 wherein said lower guide is a lower guide plate.

5. The grouping head hoist of claim 1 wherein said means to lift the projectiles includes power drive means mounted to said lower guide plate and operable to bidirectionally vary the position of said lines relative to said lower guide plate.

6. A grouping head hoist for grouping and lifting a plurality of projectiles comprising:

(a) an upper support;

(b) a lower guide mounted to said upper support, said lower guide having a plurality of holes arranged in an array;

(c) a plurality of lines, each of said lines having an upper end supported by said upper support and a lower end disposable below said lower guide with the line extending through a corresponding one of said holes; and (d) a plurality of couplers, each of said couplers attached at the lower end of a corresponding one of said lines and conformably shaped to seat within a corresponding one of said holes, each of said couplers including securing means securable to a nose of a projectile; and wherein said grouping head hoist is disposable in:

I. a loading state with each of said couplers disposed below said lower guide such that each of said couplers is securable to a nose of a corresponding projectile; and II. a rearranging state with each of said couplers disposed at least partially in the corresponding one of said holes; and means operable to lift the projectiles and rearrange said projectiles into an array corresponding to said array of holes thereby assuming said rearranging state, and wherein said means to lift includes power drive means mounted to said lower guide plate and operable to bidirectionally vary the position of said lines relative to said lower guide plate, and wherein said power drive means is operable to change said grouping head hoist from said loading state to said rearranging state by raising and lowering said lines while said lower guide is stationary.

7. The grouping head hoist of claim 6 wherein said power drive means is operable to raise and lower said lines by raising and lowering said upper support relative to said lower guide.

8. The grouping head hoist of claim 1 wherein said upper support is fixed relative to said lower guide.

9. A grouping head hoist for grouping and lifting a plurality of projectiles comprising:

(a) an upper support;

(b) a lower guide mounted to said upper support, said lower guide having a plurality of holes arranged in an array;

(c) a plurality of lines, each of said lines having an upper end supported by said upper support and a lower end disposable below said lower guide with the line extending through a corresponding one of said holes; and (d) a plurality of securing means attached at the lower end of a corresponding one of said lines and securable to a nose of a projectile; and wherein said grouping head hoist is disposable in:

I. a loading state with each of said securing means disposed below said lower guide such that each of said securing means is securable to a nose of a corresponding projectile; and II. a rearranging state with each of said securing means disposed above its position in the loading state; and means operable to lift the projectiles and rearrange said projectiles into an array corresponding to said array of holes thereby assuming said rearranging state, and wherein said upper support is fixed relative to said lower guide, and wherein said means to lift includes power drive means mounted to said grouping head hoist and operable to change said grouping head hoist from its loading state to its rearranging state by reeling up each of said lines; and a reel portion for each of said lines, and each of said lines is wound around the corresponding reel portion when said grouping head hoist is disposed in said rearranging mode.

10. The grouping head hoist of claim 9 wherein said power drive means includes a drive motor, a worm drive driven by said drive motor, at least one worm gear portion driven by said worm drive and operable to rotate a plurality of said reel portions.

11. The grouping head hoist of claim 9 further comprising an automatic turn counting mechanism operable to limit rotation of said reel portions to a predetermined number of turns greater than one turn.

12. The grouping head hoist of claim 9 further comprising: a plurality of pulleys, each pulley receiving a corresponding one of said lines; and a plurality of springs, each spring biasing a corresponding one of said pulleys.

13. A grouping head hoist for grouping and lifting a plurality of projectiles comprising:

(a) an upper support;

(b) a lower guide mounted to said upper support, said lower guide having a plurality of holes arranged in an array;

(c) a plurality of lines, each of said lines having an upper end supported by said upper support and a lower end disposable below said lower guide with the line extending through a corresponding one of said holes; and (d) a plurality of securing means attached at the lower end of a corresponding one of said lines and securable to a nose of a projectile; and wherein said grouping head hoist is disposable in:

I. a loading state with each of said securing means disposed below said lower guide such that each of said securing means is securable to a nose of a corresponding projectile; and II. a rearranging state with each of said securing means disposed above its position in the loading state; and means operable to lift the projectiles and rearrange said projectiles into an array corresponding to said array of holes thereby assuming said rearranging state, and wherein said upper support is fixed relative to said lower guide, and wherein said means to lift includes further comprising a linkage assembly having: a plurality of links, each link having two ends and being pivotably attached at least at one of its ends to an adjacent one of said links, a lower one of said links having an end pivotably mounted to said upper support; and a plurality of cross-links, each cross-link having two ends and being pivotably attached at least at one of its ends to an adjacent one of said cross-links, a lower one of said cross-links having an end slidably mounted to said upper support, each of said cross-links crossing and pivotably connected to a corresponding one of said links; and wherein said linkage assembly is operable to expand and contract by pivoting of said links and said cross-links and is operable to stabilize said upper support.

14. The grouping head hoist of claim 13 wherein each of said links includes a channel and further comprising a pressurized-fluid power conduit mounted in said channel.

15. The grouping head hoist of claim 8 further comprising releasing means operable to simultaneously release projectiles from each of said securing means.

16. The grouping head hoist of claim 15 wherein each of said securing means is operable to prevent the release of a projectile if the projectile's weight is applied to the securing means.

17. The grouping head hoist of claim 16 wherein said releasing means includes a release plate mounted below said lower guide and downwardly movable to release each of said securing means.

18. The grouping head hoist of claim 17 wherein said releasing means further includes a release cylinder operable to pivot two release links, each release link operable to push said plate downwardly.

19. A grouping head hoist for grouping and lifting a plurality of projectiles comprising:

(a) an upper support;

(b) a lower guide supported by said upper support, said lower guide having a plurality of holes arranged in an array;

(c) a plurality o lines, each of said lines having an upper end supported by an upper support and a lower end disposable below said lower guide with the line extending through a corresponding one of said holes;

(d) a plurality of securing means attached at the lower end of a corresponding one of said lines, and securable to the nose of a projectile; and (e) power drive means mounted to said lower guide and operable to bidirectionally vary the position of said lines relative to said lower guide; and wherein said grouping head hoist is disposable in:

I. a loading state with each of said securing means disposed below said lower guide such that each of said securing means is securable to a nose of a corresponding projectile; and II. a rearranging state with each of said securing means disposed in a higher position than when in said loading state; and wherein said power drive means is operable to lift the projectiles and rearrange said projectiles into an array corresponding to said array of holes thereby assuming said rearranging state.

20. The grouping head hoist of claim 19 further comprising a plurality of couplers and each securing means is part of a corresponding one of said couplers, each of said couplers has at least a partially conical upper tip and each of said holes is at least partially conical, and each of said couplers is disposed at least partially within the corresponding one of said holes when said grouping head hoist is in said rearranging state.

21. The grouping head hoist of claim 19 wherein said grouping head hoist is operable to rearrange projectiles with said lower guide remaining stationary.

22. The grouping head hoist of claim 19 further comprising a linkage assembly having: a plurality of links, each link having two ends and being pivotably attached at least at one of its ends to an adjacent one of said links, a lower one of said links having an end pivotably mounted to said upper support; and a plurality of cross-links, each cross-link having two ends and being pivotably attached at least at one of its ends to an adjacent one of said cross-links, a lower one of said cross-links having an end slidably mounted to said upper support, each of said cross-links crossing and pivotably connected to a corresponding one of said links; and wherein said linkage assembly is operable to expand and contract by pivoting of said links and said cross-links and is operable to stabilize said upper support.

23. The grouping head hoist of claim 19 wherein said lower guide is a guide plate.

24. The grouping head hoist of claim 23 wherein said power drive means is operable to change said grouping head hoist from said loading state to said rearranging state by raising and lowering said lines while said lower guide is stationary.

25. The grouping head hoist of claim 19 wherein each of said lines has its upper end attached to allow rotation of the line about a corresponding reel portion mounted above said lower guide and wherein said grouping head hoist is operable to rearrange projectiles into an array corresponding to said array of holes by said power drive means winding each of said lines around its corresponding reel portion such that the projectiles are lifted and the grouping head hoist is disposed in said rearranging state.

26. The grouping head hoist of claim 25 wherein each of said securing means is part of a corresponding coupler conformably shaped to seat within a corresponding one of said holes when the grouping head hoist is disposed in said rearranging state.

27. The grouping head hoist of claim 25 wherein said upper support is an upper support cover and said lower guide is mounted a fixed distance below said upper support cover.

28. The grouping head hoist of claim 25 further comprising releasing means operable to simultaneously release projectiles from each of said securing means.

29. The grouping head hoist of claim 28 wherein said releasing means comprises a release plate mounted below said lower guide and downwardly movable to release each of said securing means.

30. A grouping head hoist for grouping and lifting a plurality of projectiles comprising:

(a) an upper support;

(b) a lower guide supported by said upper support and having a plurality of holes arranged in an array;

(c) a plurality of lines, each of said lines having an upper end supported by said upper support and a lower end disposable below said lower guide with the line extending through a corresponding one of said holes; and (d) a plurality of securing means attached at the lower end of a corresponding one of said lines, each of said securing means operable to secure a nose of a projectile; and (e) releasing means operable to simultaneously release projectiles from each of said securing means; and wherein said grouping head hoist is disposable in:

I. a loading state with each of said securing means disposed below said lower guide such that each of said securing means is securable to a nose of a corresponding projectile; and II. a rearranging state with each of said securing means disposed above its position in the loading state; and means operable to lift the projectiles and rearrange said projectiles into an array corresponding to said array of holes thereby disposing said grouping head hoist in said rearranging state.

31. The grouping head hoist of claim 30 wherein said means to lift the projectiles includes power drive means mounted to said grouping head hoist and operable to change said grouping head hoist from its loading state to its rearranging state by reeling up each of said lines.

32. The grouping head hoist of claim 31 wherein each of said securing means is part of a corresponding coupler conformably shaped to seat within a corresponding one of said holes when the grouping head hoist is disposed in said rearranging mode.

33. The grouping head hoist of claim 32 wherein each of said securing means is operable to prevent the release of a projectiles if the projectile's weight is applied to said securing means.

34. The grouping head hoist of claim 30 wherein said releasing means comprises at least one release member downwardly movable to release at least one of said securing means.

35. The grouping head hoist of claim 30 wherein each of said securing means is a spring-loaded pair of jaws mounted within a coupler body.

36. The grouping head hoist of claim 35 wherein each of said pairs of jaws is securable to snap around a projectile lifting eye loop by pushing said coupler body towards the projectile nose.

37. The grouping head hoist of claim 36 wherein each pair of jaws is shaped to be self-gripping under load such that removal is not possible under load.

38. The grouping head hoist of claim 37 wherein said releasing means comprises at least one release member downwardly movable to release at least one of said securing means.

39. The grouping head hoist of claim 38 wherein said release member is operable to pivot at least one of said pairs of jaws open.

40. The grouping head hoist of claim 30 wherein each of said lines reels around a corresponding reel portion and each reel portion is mounted to on a common shaft.

41. The grouping head hoist of claim 30 wherein each of said lines is spring-biased to take up any slack when the grouping head hoist is in said rearranging state.

42. The grouping head hoist of claim 30 further comprising a plurality of pivotable links extendable above said upper support and at least partially enclosing at least one control line extending from up said grouping head hoist.

* * * * *

UNITED STATES PATENT AND TRADEMARK OFFICE

CERTIFICATE OF CORRECTION

PATENT NO. : 4,664,434

DATED : May 12, 1987

INVENTOR(S) : Borst et al

It is certified that error appears in the above-identified patent and that said Letters Patent is hereby corrected as shown below:

Column 20, line 55, "o" should be --of--.
Column 22, line 43, "projectiles" should be --projectile--.
Column 22, line 68, "is mounted to on" should be --is mounted on to--.

Signed and Sealed this

Twentieth Day of October, 1987

*Attest:*

DONALD J. QUIGG

*Attesting Officer*

*Commissioner of Patents and Trademarks*